US007760218B2

(12) United States Patent
Arai et al.

(10) Patent No.: US 7,760,218 B2
(45) Date of Patent: Jul. 20, 2010

(54) INFORMATION RECORDING APPARATUS AND INFORMATION RECORDING METHOD

(75) Inventors: Satoshi Arai, Shizuoka (JP); Takashi Ohkuma, Kanagawa (JP); Nobuyoshi Sugiyama, Shizuoka (JP); Hideo Sakurai, Shizuoka (JP); Takayuki Toba, Mie (JP); Shigeyuki Kawamura, Mie (JP); Takanobu Mimura, Mie (JP)

(73) Assignees: Ricoh Company, Ltd., Tokyo (JP); Shinko Electric Co., Ltd., Tokyo (JP)

( * ) Notice: Subject to any disclaimer, the term of this patent is extended or adjusted under 35 U.S.C. 154(b) by 39 days.

(21) Appl. No.: 12/325,034

(22) Filed: Nov. 28, 2008

(65) Prior Publication Data

US 2010/0045771 A1 Feb. 25, 2010

(30) Foreign Application Priority Data

Aug. 22, 2008 (JP) ..... 2008-214479

(51) Int. Cl.
*B41J 2/325* (2006.01)
*B41M 5/00* (2006.01)

(52) U.S. Cl. ..... 347/171

(58) Field of Classification Search ..... 347/171; 400/120.01

See application file for complete search history.

(56) References Cited

U.S. PATENT DOCUMENTS

2007/0216703 A1 9/2007 Ohkuma et al.
2008/0062236 A1 3/2008 Sakurai et al.
2008/0062237 A1 3/2008 Sakurai et al.
2008/0246829 A1 10/2008 Sakurai et al.

FOREIGN PATENT DOCUMENTS

| | | | |
|---|---|---|---|
| JP | 6-143627 | | 5/1994 |
| JP | 9-35095 | | 2/1997 |
| JP | 2000-52576 | | 2/2000 |
| JP | 2001-239688 | | 9/2001 |
| JP | 2002-234201 | * | 8/2002 |
| JP | 2003-211710 | | 7/2003 |
| JP | 2004-188934 | | 7/2004 |
| JP | 2004-195809 | | 7/2004 |
| JP | 2004-345334 | * | 12/2004 |
| JP | 2005-111869 | | 4/2005 |
| JP | 2005-161736 | | 6/2005 |
| JP | 2005-193604 | | 7/2005 |
| JP | 2005-225043 | | 8/2005 |
| JP | 3996149 | | 8/2007 |
| JP | 2008-65686 | | 3/2008 |
| JP | 2008-146488 | | 6/2008 |

* cited by examiner

*Primary Examiner*—Huan H Tran
(74) *Attorney, Agent, or Firm*—Oblon, Spivak, McClelland, Maier & Neustadt, L.L.P.

(57) ABSTRACT

A disclosed information recording apparatus includes an erasing unit configured to erase prerecorded information on recording media capable of being colored and decolored by heat; a recording unit configured to record information on the recording media from which the prerecorded information is erased; and a control unit configured, when a recording request is received, to cause the recording unit to start recording information on a first one of the recording media and to cause the erasing unit to start erasing prerecorded information on a second one of the recording media.

13 Claims, 9 Drawing Sheets

INFORMATION RECORDING APPARATUS AND INFORMATION RECORDING METHOD

BACKGROUND OF THE INVENTION

1. Field of the Invention

The present invention generally relates to an information recording apparatus and an information recording method. More particularly, the present invention relates to an information recording apparatus and an information recording method for erasing prerecorded information on a recording medium and recording new information on the recording medium.

2. Description of the Related Art

Reversible thermal recording media (hereafter, may be simply called thermal recording media), on which information can be recorded and erased repeatedly by using, for example, a thermal printer, are drawing attention in terms of environmental protection and recycling. A typical thermal recording medium includes a recording layer on which leuco dye, which interchangeably takes colored and decolored states, is applied. Information can be recorded on or erased from the thermal recording medium by partially coloring or decoloring the recording layer by applying appropriate heat to the recording layer. Patent document 1 discloses a thermal printer for repeatedly recording information on such a thermal recording medium.

[Patent document 1] Japanese Patent Application Publication No. 2008-65686

Generally, before information is recorded on a thermal recording medium using, for example, a thermal printer, prerecorded information is erased from the thermal recording medium. Therefore, with a conventional thermal printer, extra time is necessary to heat an erasing head to an erasing temperature and to erase prerecorded information on a thermal recording medium with the heated erasing head before information can be recorded on the thermal recording medium after a recording request is input, for example, by a user.

Also, before starting to erase information on a thermal recording medium, it is necessary to heat a heating device of a thermal printer to a temperature (erasing temperature) needed to erase information on the thermal recording medium. Accordingly, when the heating device is cooled to about the ambient temperature, it takes some time to heat the heating device to the erasing temperature. Thus, when recording information on a thermal recording medium some time after the previous recording, it is necessary to reheat a cooled heating device to an erasing temperature and therefore the time required before starting the information recording on the thermal recording medium after a recording request is received becomes even longer.

SUMMARY OF THE INVENTION

Aspects of the present invention provide an information recording apparatus and an information recording method that solve or reduce one or more problems caused by the limitations and disadvantages of the related art.

According to an aspect of the present invention, an information recording apparatus includes an erasing unit configured to erase prerecorded information on recording media capable of being colored and decolored by heat; a recording unit configured to record information on the recording media from which the prerecorded information is erased; and a control unit configured, when a recording request is received, to cause the recording unit to start recording information on a first one of the recording media and to cause the erasing unit to start erasing prerecorded information on a second one of the recording media.

According to another aspect of the present invention, an information recording method includes a first step of starting to record information on a first recording medium when a recording request is received; and a second step of starting to erase prerecorded information on a second recording medium when the recording request is received.

DESCRIPTION OF THE PREFERRED EMBODIMENTS

Preferred embodiments of the present invention are described below with reference to the accompanying drawings.

Figure 1:
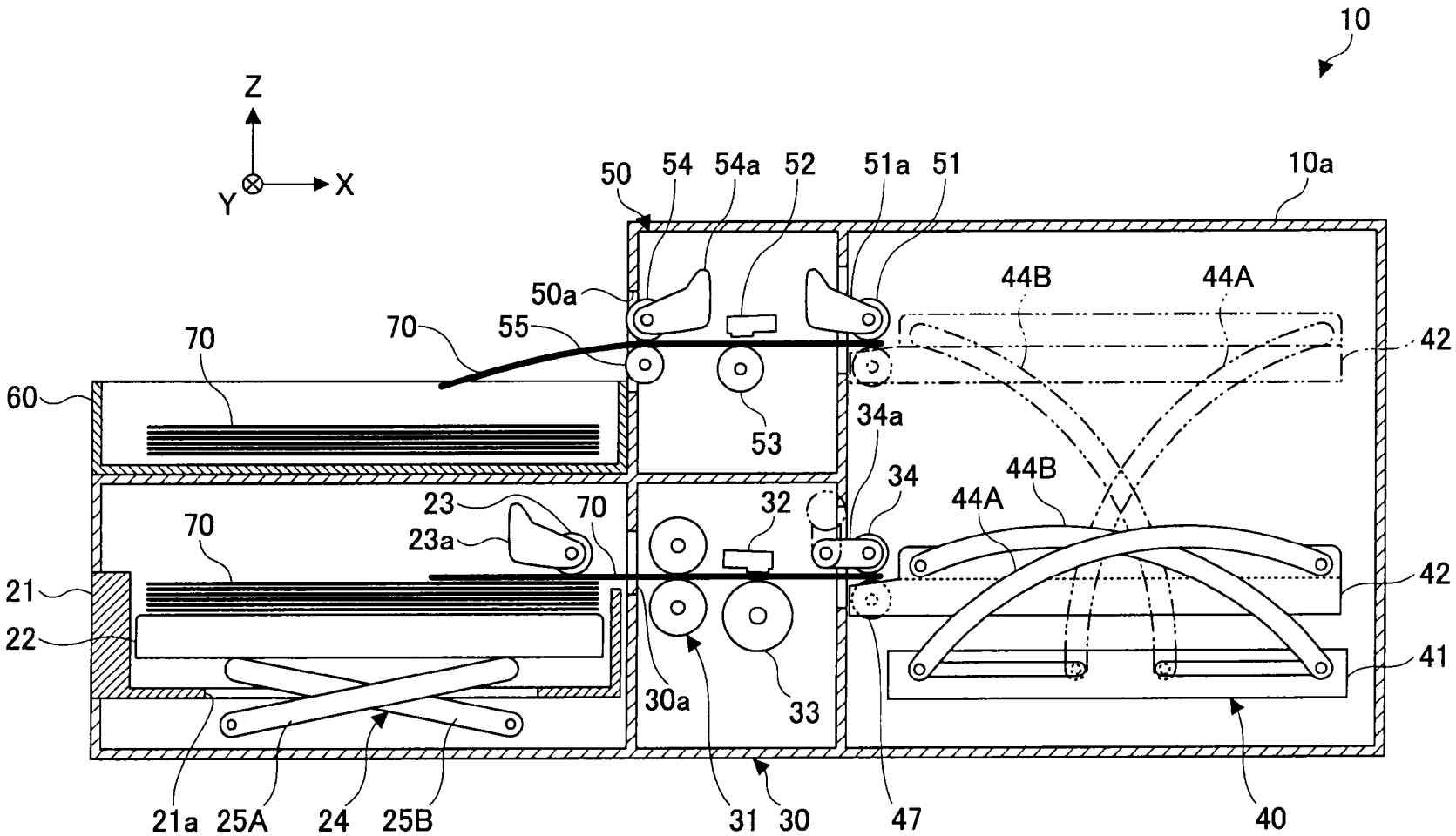
FIG. 1 is a schematic diagram illustrating a configuration of an image forming apparatus 10 according to an embodiment of the present invention.

FIG. 1 is a schematic diagram illustrating a configuration of an image forming apparatus 10 according to an embodiment of the present invention. The image forming apparatus 10 is an example of a thermal printer and configured to erase information from and record information on a thermal recording medium 70. The image forming apparatus 10 includes an erasing unit 30, a recording unit 50, a lifter 40 (provided as an example of a conveying mechanism), a paper-feed cassette 21, an elevating mechanism 24, a paper-feed roller 23, a paper catch tray 60, a main control unit 100 (see FIG. 6), and a case 10*a* for housing the above components.

Figure 2:
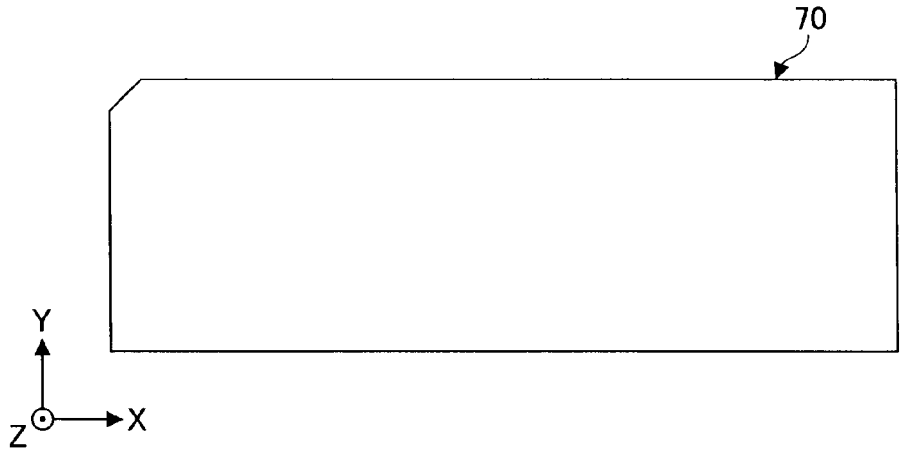
FIG. 2 is a drawing illustrating a thermal recording medium 70.

As shown by a plan view of FIG. 2, the thermal recording medium 70 is long in the X-axis direction. The thermal recording medium 70 includes a base material and a recording material laminated on the upper surface (+Z side) of the base material.

Figure 3:
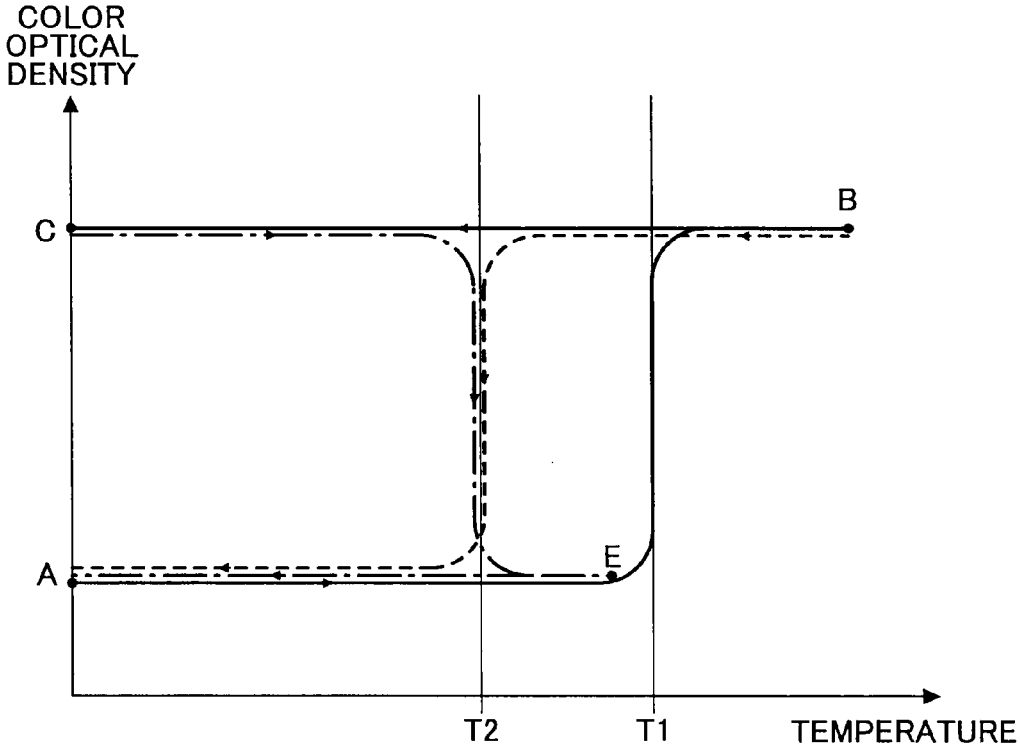
FIG. 3 is a graph showing temperature characteristics of the thermal recording medium 70.

The recording material can be decolored and colored by a thermal head (thermoreversible) and can be partially colored according to the difference in the heating temperature and the cooling rate after being heated. FIG. 3 is a graph showing the relationship between the color optical density and the temperature (temperature characteristics) of the thermal recording medium 70 including the recording material. When the thermal recording medium 70 in a decolored state A is heated, the state of the thermal recording medium 70 changes as shown by a solid line in FIG. 3. When the temperature of the thermal recording medium 70 becomes close to a temperature T1, the thermal recording medium 70 starts to develop color and finally reaches a colored state B. If the thermal recording medium 70 in the colored state B is cooled rapidly, the thermal recording medium 70 reaches a colored state C as shown by the solid line where it remains colored even at the ambient temperature. If the thermal recording medium 70 in the colored state B is cooled slowly, the state of the thermal recording medium 70 changes as shown by a dotted line shown in FIG. 3. When the temperature of the thermal recording medium 70 becomes close to a temperature T2, the thermal recording medium 70 starts to lose color and finally reaches the decolored state A. Meanwhile, if the thermal recording medium 70 in the colored state C is heated, the state of the thermal recording medium 70 changes as shown by a dashed-dotted line shown in FIG. 3. When the temperature of the thermal recording medium 70 becomes close to the temperature T2 that is lower than the temperature T1, the thermal recording medium 70 starts to lose color and reaches a decolored state E. If the thermal recording medium 70 in the decolored state E is cooled, the thermal recording medium 70 reaches the decolored state A as shown by the dashed-dotted line shown in FIG. 3. Thus, it is possible to erase information from or record information on the thermal recording medium 70 by appropriately heating the upper surface of the thermal recording medium 70 with, for example, a thermal head.

Referring back to FIG. 1, the paper-feed cassette 21 is a box-shaped part without a top wall. The paper-feed cassette 21 has an opening 21*a* in its bottom wall and contains a tray 22 movable in the Z-axis direction. On the tray 22, multiple thermal recording media 70 are stacked such that their longer sides become parallel to the X-axis direction. When the paper-feed cassette 21 is inserted into the case 10*a*, the tray 22 is pushed upward by the elevating mechanism 24 rising through the opening 21*a* of the paper-feed cassette 21. The elevating mechanism 24 includes bar-like parts 25A and 25B that are rotatable upward around the −X end and the +X end (i.e., around axes parallel to the Y-axis), respectively. When the tray 22 is pushed upward, the uppermost thermal recording medium 70 is pressed against the paper-feed roller 23 supported by a supporting part 23*a*. The thermal recording media 70 on the tray 22 are fed one by one by the rotation of the paper-feed roller 23 through an insertion opening 30*a* into the erasing unit 30.

The erasing unit 30 includes a pair of conveying rollers 31 that are arranged one above the other and convey the thermal recording medium 70 in the +X direction, an erasing head (heating device) 32 movable up and down and disposed on the +X side of the conveying rollers 31, a platen roller 33 disposed below the erasing head 32, and a movable roller 34 disposed on the +X side of the erasing head 32 and rotatably supported by a movable part 34*a*.

When the thermal recording medium 70 is fed into the erasing unit 30, the main control unit 100 causes the erasing unit 30 to bring the erasing head 32 into contact with the thermal recording medium 70 supported from underneath by the platen roller 33 while moving the thermal recording medium 70 in the +X direction by the conveying rollers 31 and the platen roller 33. Then, the main control unit 100 causes the erasing head 32 to heat the upper surface of the thermal recording medium 70 to a temperature greater than or equal to the temperature T2 shown in FIG. 3 and thereby to erase information recorded on the thermal recording medium 70. The temperature of the erasing head 32 is detected, for example, by a temperature sensor (not shown) and the detected temperature is fed back to the main control unit 100.

After the information is erased, the thermal recording medium 70 is conveyed further in the +X direction. When the +X end of the thermal recording medium 70 passes above a conveying roller 47 of a carrying tray 42 (provided as an example of a temporary storing mechanism), the movable part 34*a* is turned to a position indicated by a solid line from a position indicated by an imaginary line shown in FIG. 1. As a result, the thermal recording medium 70 is pinched between the movable roller 34 and the conveying roller 47. Then, the conveying roller 47 is rotated and the thermal recording medium 70 is thereby placed on a bed 42*a* (see FIG. 4) of the carrying tray 42.

Figure 4:
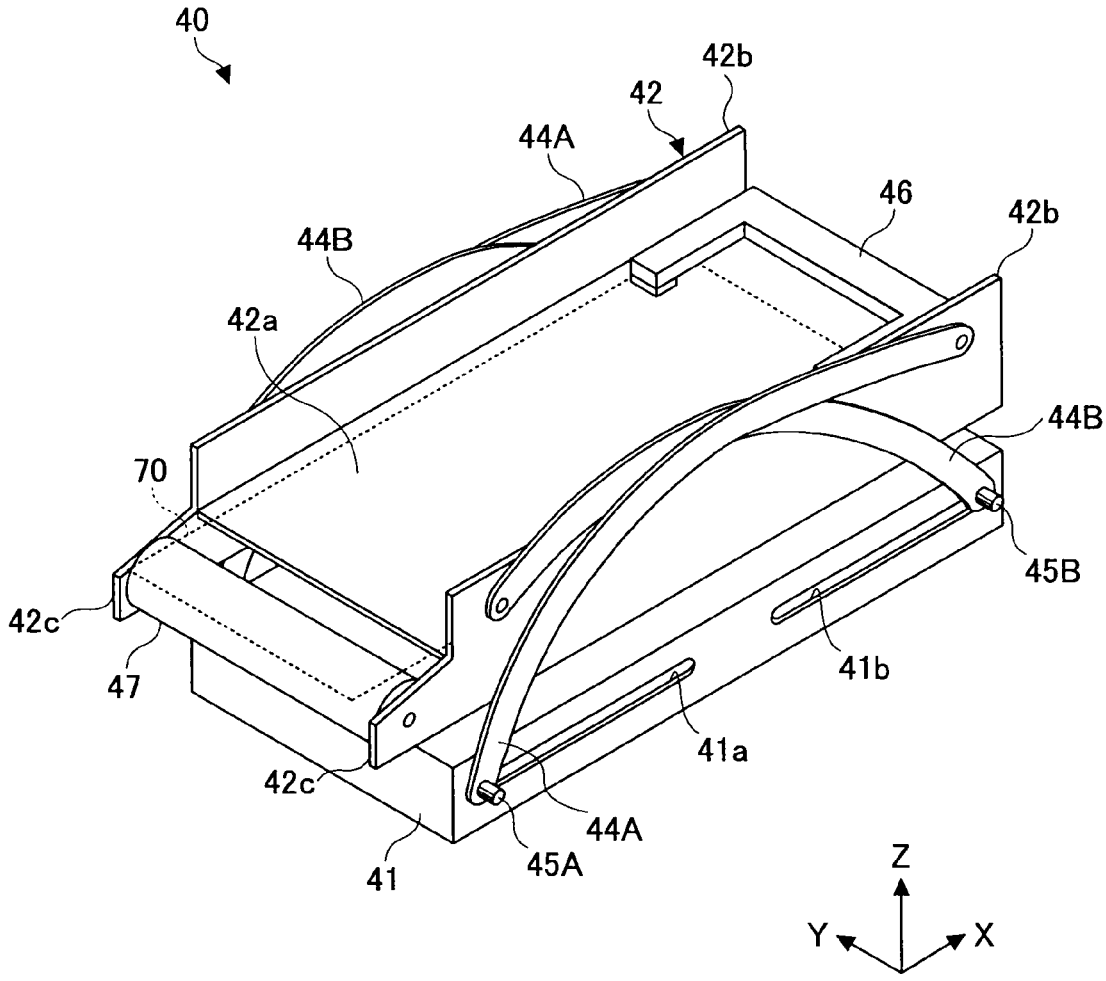
FIG. 4 is a perspective view of a lifter 40.

FIG. 4 is a perspective view of the lifter 40. As shown in FIG. 1 and FIG. 4, the lifter 40 is contained in the case 10*a* and includes an elevating unit 41 shaped like a cuboid and disposed on the +X side of the erasing unit 30, the carrying tray 42 joined to the elevating unit 41 by a pair of link bars 44A and a pair of link bars 44B, a clamper 46 for clamping the thermal recording medium 70 placed on the carrying tray 42, and the conveying roller 47 disposed near the −X end of the carrying tray 42 such that its longitudinal direction becomes parallel to the Y-axis direction.

The elevating unit 41 is placed on the bottom wall of the case 10*a* via a supporting part (not shown) such that its longitudinal direction becomes parallel to the X-axis direction. The −Y side wall of the elevating unit 41 has a guide slot 41*a* extending in the X-axis direction from the −X end toward the center and a guide slot 41*b* extending in the X-axis direction from the +X end toward the center. Movable shafts 45A and 45B are inserted in the corresponding guide slots 41*a* and 41*b* so as to be movable along the slots. Similarly, the +Y side wall of the elevating unit 41 has a guide slot 41*a* extending in the X-axis direction from the −X end toward the center and a guide slot 41*b* extending in the X-axis direction from the +X end toward the center. Movable shafts 45A and 45B are inserted in the corresponding guide slots 41*a* and 41*b* so as to be movable along the slots. The two pairs of movable shafts 45A and 45B on the +Y side and the −Y side of the elevating unit 41 are moved synchronously along the X-axis direction by a driving mechanism (not shown).

Figure 5A:
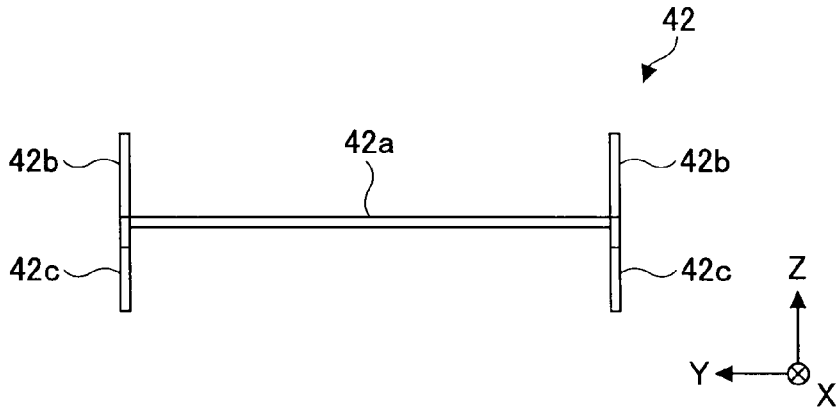
FIG. 5A is a drawing illustrating a carrying tray 42 seen from the −X side.
Figure 5B:
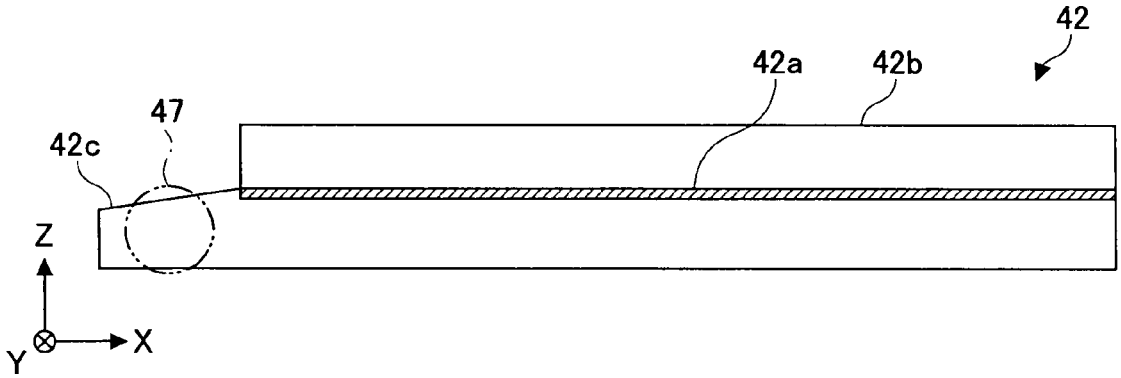
FIG. 5B is a drawing illustrating the carrying tray 42 seen from the −Y side.

FIG. 5A is a drawing illustrating the carrying tray 42 seen from the −X side; and FIG. 5B is a cutaway-side view of the carrying tray 42 on the X-Z plane. As shown in FIGS. 5A and 5B, the carrying tray 42 includes the bed 42*a* shaped like a rectangular plate that is long in the X-axis direction, a pair of side walls 42*b* disposed at the −Y end and the +Y end of the bed 42*a* such that the side walls 42*b* become orthogonal to the upper surface of the bed 42*a* and their longitudinal directions become parallel to the X-axis direction, and a pair of roller supporting parts 42*c* extending from the −X ends of the corresponding side walls 42*b* in the −X direction.

The +Y end and the −Y end of the conveying roller 47 are rotatably supported by the roller supporting parts 42*c* of the carrying tray 42 such that the upper surface of the conveying roller 47 is positioned at substantially the same height as that of the upper surface of the bed 42*a*. The conveying roller 47 is rotatable by a driving mechanism (not shown) around an axis parallel to the Y-axis in a forward direction (clockwise in FIG. 1) and a backward direction (counterclockwise in FIG. 1).

The clamper 46, as shown in FIG. 4, has a U-shape in plan view and includes a rotating part parallel to the Y-axis direction and a pair of clamping parts extending in the −X direction from ends of the rotating part. The rotating part of the clamper 46 is attached to the +X end of the bed 42*a* of the carrying tray 42 so as to be rotatable around an axis parallel to the Y-axis.

The link bars 44A have a curved shape curving outward and are disposed, respectively, on the +Y side and the −Y side of the elevating unit 41 and the carrying tray 42. The +X ends of the link bars 44A are attached to the upper portions of the +X ends of the side walls 42*b* of the carrying tray 42 so as to be rotatable around an axis parallel to the Y-axis. The −X ends of the link bars 44A are attached to the movable shafts 45A of the elevating unit 41 so as to be rotatable around an axis parallel to the Y-axis. The link bars 44B have a shape similar to that of the link bars 44A. The −X ends of the link bars 44B are attached to the upper portions of the −X ends of the side walls 42*b* of the carrying tray 42 so as to be rotatable around an axis parallel to the Y-axis. The +X ends of the link bars 44B are attached to the movable shafts 45B of the elevating unit 41 so as to be rotatable around an axis parallel to the Y-axis.

The lifter 40 configured as described above is controlled by the main control unit 100. When the movable shafts 45A are moved in the −X direction and the movable shafts 45B are moved in the +X direction by the elevating unit 41, the carrying tray 42 descends and is placed in a position (carry-in position) indicated by a solid line in FIG. 1. When the movable shafts 45A are moved in the +X direction and the movable shafts 45B are moved in the −X direction by the elevating unit 41, the carrying tray 42 ascends and is placed in a position (carry-out position) indicated by an imaginary line in FIG. 1. Meanwhile, while the carrying tray 42 is moving, the main control unit 100 causes a driving mechanism (not shown) to turn the clamper 46 so that the thermal recording medium 70 on the bed 42*a* is held between the pair of clamping parts of the clamper 46 and the upper surface of the bed 42*a*.

The recording unit 50 is disposed above (on the +Z side) of the erasing unit 30. The recording unit 50 includes a pull-in roller 51 supported by a supporting part 51*a* movable up and down, a recording head 52 disposed on the −X side of the pull-in roller 51 and movable up and down, a platen roller 53 disposed below the recording head 52, a first ejecting roller 54 disposed on the −X side of the recording head 52 and supported by a supporting part 54*a* movable up and down, and a second ejecting roller 55 disposed below the first ejecting roller 54.

When the carrying tray 42 is placed in the carry-out position, the main control unit 100 causes the recording unit 50 to drive the supporting part 51*a* so that the thermal recording medium 70 is pinched between the pull-in roller 51 and the conveying roller 47 of the carrying tray 42. Then, when the conveying roller 47 of the carrying tray 42 is rotated, the −X end of the thermal recording medium 70 is pulled into a space between the recording head 52 and the platen roller 53. When the −X end of the thermal recording medium 70 is pulled into a space between the recording head 52 and the platen roller 53, the main control unit 100 causes the recording unit 50 to bring the recording head 52 into contact with the upper surface of the thermal recording medium 70 being supported from underneath by the platen roller 53. While feeding the thermal recording medium 70 in the −X direction by rotating the platen roller 53, the main control unit 100 causes the recording head 52 to heat the upper surface of the thermal recording medium 70 to a temperature greater than or equal to the temperature T1 and thereby to record information on the thermal recording medium 70. While information is being recorded on the thermal recording medium 70, the supporting parts 51*a* and 54*a* are moved upward and the pull-in roller 51 and the first ejecting roller 54 are thereby retracted to positions where they do not interfere with the thermal recording medium 70.

After information is recorded on the thermal recording medium 70, the main control unit 100 causes the recording unit 50 to move the supporting part 54*a* downward and thereby to bring the first ejecting roller 54 into contact with the upper surface of the thermal recording medium 70 so that the thermal recording medium 70 is pinched between the first ejecting roller 54 and the second ejecting roller 55. Then, the main control unit 100 causes the recording unit 50 to rotate the second ejecting roller 55 to eject the thermal recording medium 70 onto the paper catch tray 60 through an ejecting opening 50*a* formed in the case 10*a*.

Figure 6:
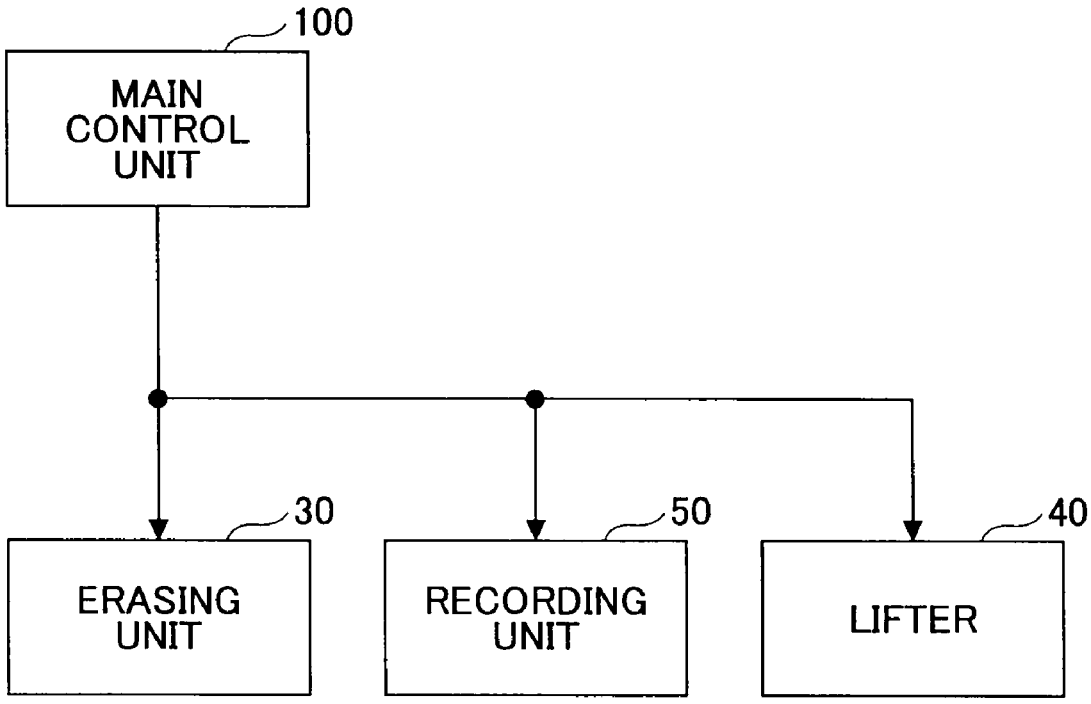
FIG. 6 is a block diagram illustrating a control system of the image forming apparatus 10.

FIG. 6 is a block diagram illustrating the image forming apparatus 10 of this embodiment. The main control unit 100 includes a microcomputer (or a workstation) including a central processing unit (CPU), a read-only memory (ROM), and a random access memory (RAM) and controls the erasing unit 30, the recording unit 50, and the lifter 40.

Next, operations of the image forming apparatus 10 are described. Here, it is assumed that the carrying tray 42 is placed in a position indicated by a solid line shown in FIG. 1.

Figure 7:
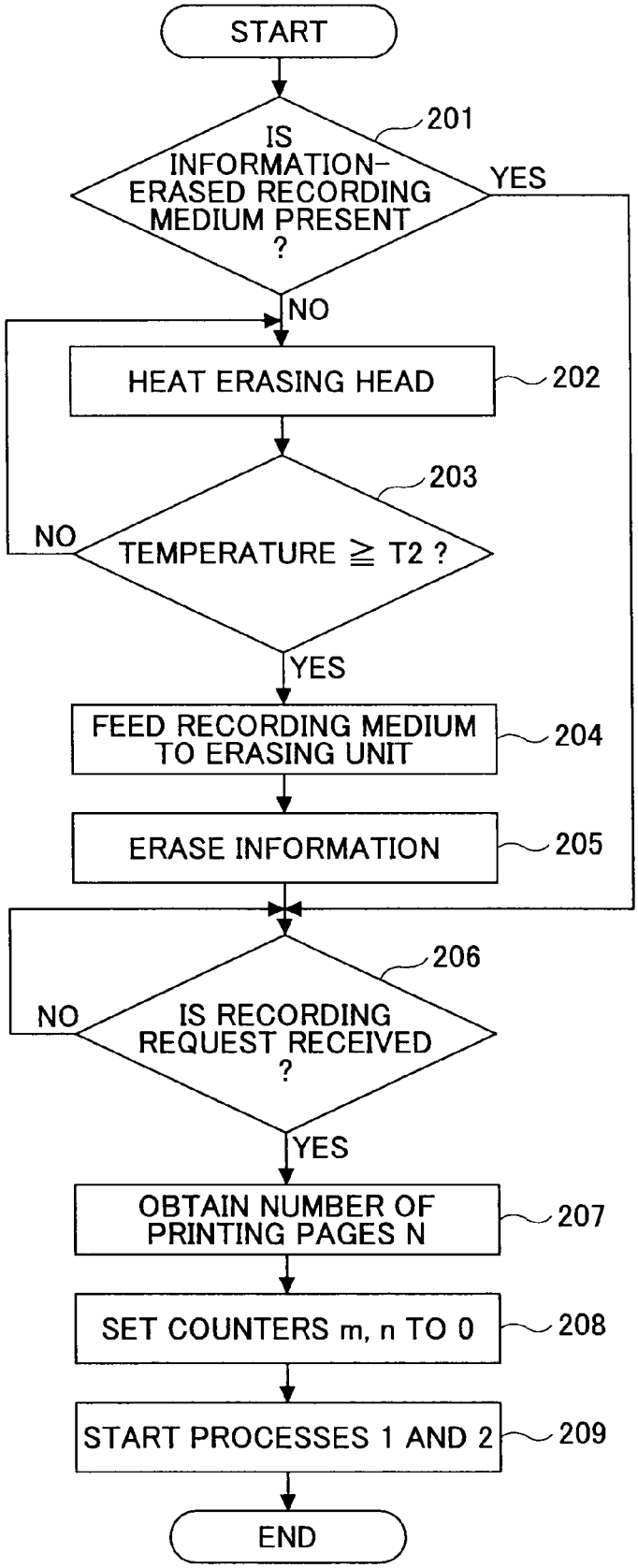
FIG. 7 is a flowchart showing a main process of the image forming apparatus 10.

When the image forming apparatus 10 is turned on, the main control unit 100 controls components of the image forming apparatus 10 according to a flowchart (main process) of FIG. 7.

<Main Process>

In step 201, when the power is turned on, the main control unit 100 determines whether a thermal recording medium 70 from which information is erased by the erasing unit 30 is present on the carrying tray 42. In the image forming apparatus 10, the thermal recording medium 70 from which information is erased by the erasing unit 30 is ejected onto the carrying tray 42. In this embodiment, the main control unit 100 detects the presence or absence of the thermal recording medium 70 on the carrying tray 42 using, for example, a detector (not shown). If no thermal recording medium 70 is present on the carrying tray 42 (NO in step 201), the process goes to step 202. Meanwhile, if a thermal recording medium 70 is present on the carrying tray 42 (YES in step 201), the process goes to step 206.

In step 202, the main control unit 100 starts supplying power to the erasing head 32 of the erasing unit 30.

As described above, information recorded on the thermal recording medium 70 can be erased by heating the thermal recording medium 70 to a temperature greater than or equal to the temperature T1 and then cooling it slowly, or by heating the thermal recording medium 70 to a temperature between the temperatures T2 and T1. In step 203, the main control unit 100 determines whether the temperature of the erasing head 32 has become greater than or equal to the temperature T2. If the temperature is greater than or equal to the temperature T2 (YES in step 203), the process goes to step 204. If the temperature is not greater than or equal to the temperature T2 (NO in step 203), the process returns to step 202 and steps 202 and 203 are repeated until the temperature becomes greater than or equal to the temperature T2.

In step 204, the main control unit 100 rotates the paper-feed roller 23 to feed the thermal recording medium 70 in the paper-feed cassette 21 in the +X direction into a space between the conveying rollers 31 of the erasing unit 30.

In step 205, the main control unit 100 brings the erasing head 32 into contact with the upper surface of the thermal recording medium 70 supported from underneath by the platen roller 33 while moving the thermal recording medium 70 in the +X direction. Then, the main control unit 100 causes the erasing head 32 to heat the upper surface of the thermal recording medium 70 to a temperature greater than or equal to the temperature T2 shown in FIG. 3 and thereby to erase information recorded on the thermal recording medium 70.

After erasing information from the thermal recording medium 70, the main control unit 100 turns the movable part 34*a* to pinch the thermal recording medium 70 between the movable roller 34 and the conveying roller 47. Then, the main control unit 100 rotates the conveying roller 47 to convey the thermal recording medium 70 onto the bed 42*a* of the carrying tray 42. As a result, as indicated by a dotted line in FIG. 4, the thermal recording medium 70 is placed on the carrying tray 42 with its −X end positioned above the conveying roller 47.

In step 206, the main control unit 100 determines whether a recording request has been received from a higher-order device such as a personal computer. If a recording request has been received (YES in step 206), the process goes to step 207.

In step 207, the main control unit 100 obtains information on the number of printing pages N (the number of pages to be printed) from the higher-order device.

In step 208, the main control unit 100 sets a counter m and a counter n indicating the number of pages processed at 0.

Figure 8:
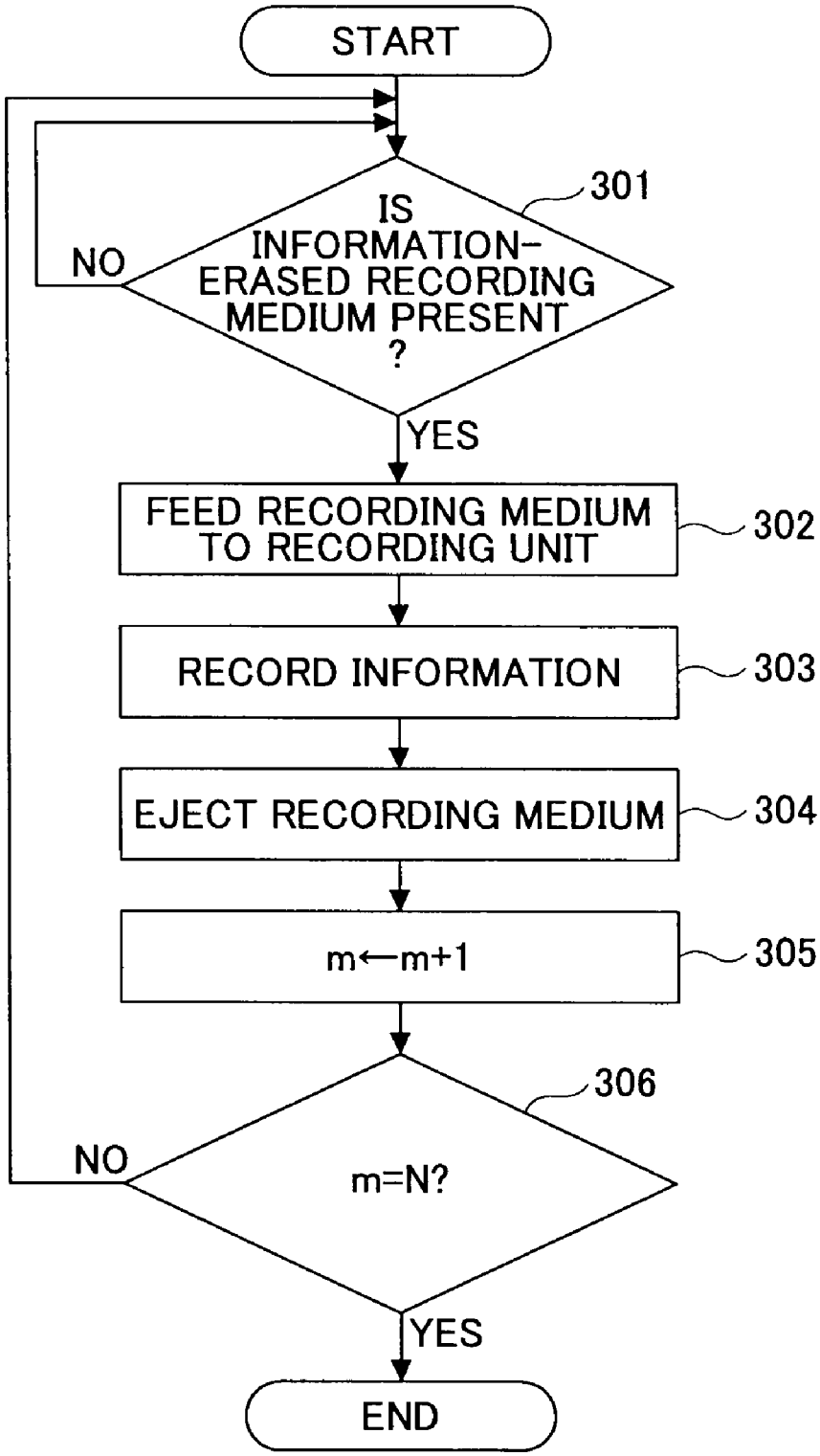
FIG. 8 is a flowchart showing a process 1 of the image forming apparatus 10.
Figure 9:
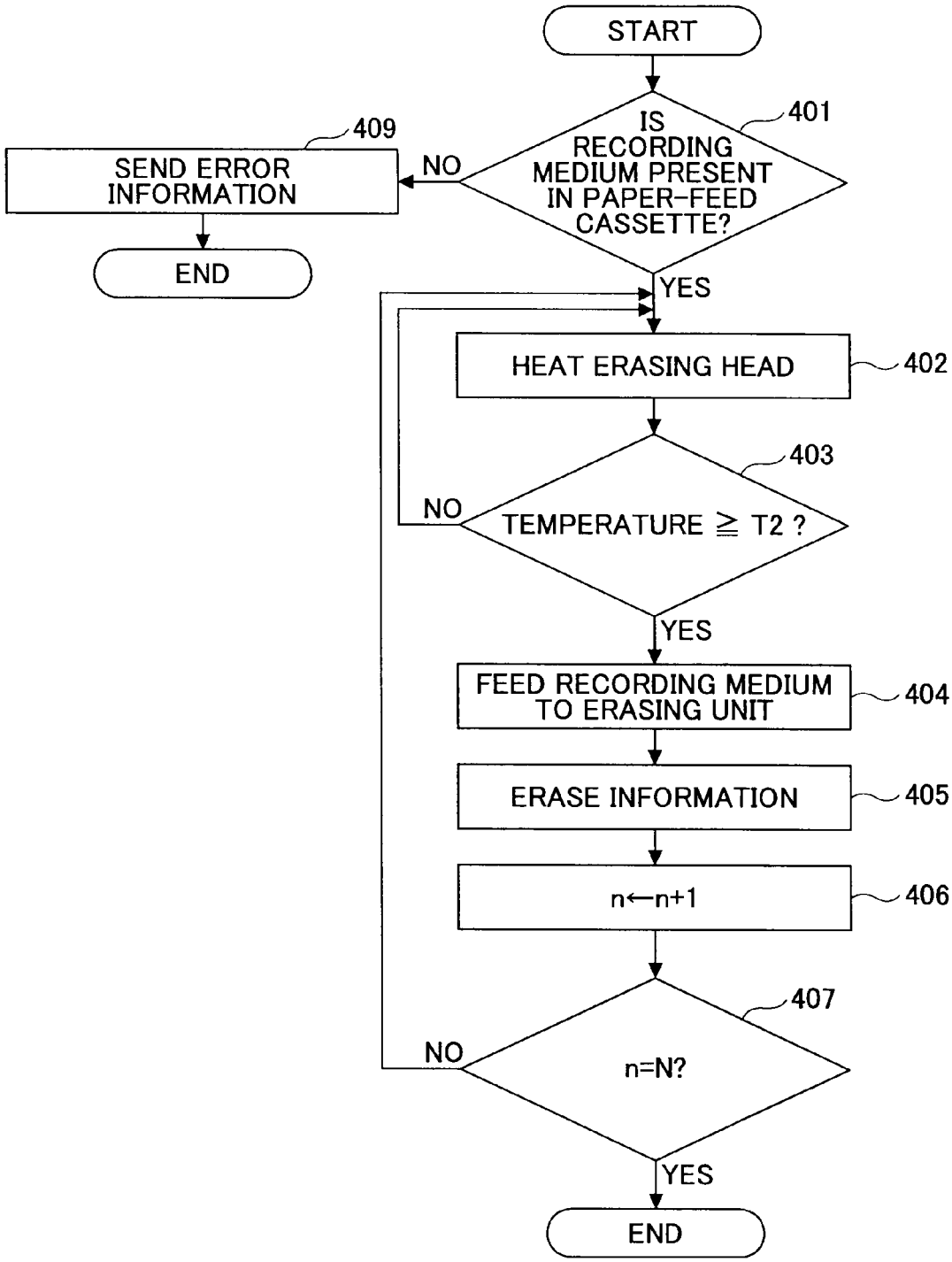
FIG. 9 is a flowchart showing a process 2 of the image forming apparatus 10.

In step 209, the main control unit 100 executes processes 1 and 2 shown in FIGS. 8 and 9 concurrently.

<Process 1>

In step 301 of the process 1, the main control unit 100 determines whether a thermal recording medium 70 from which information is erased by the erasing unit 30 is present on the carrying tray 42. If no thermal recording medium 70 is present on the carrying tray 42 (NO in step 301), the process 1 is suspended until the thermal recording medium 70 from which information is erased is placed on the carrying tray 42 by the process 2 described later. Meanwhile, if a thermal recording medium 70 is present on the carrying tray 42 (YES in step 301), the process goes to step 302.

In step 302, the main control unit 100 drives the elevating unit 41 of the lifter 40 to move the carrying tray 42 on which the thermal recording medium 70 is placed to the carry-out position. Then, the main control unit 100 drives the supporting part 51*a* to bring the pull-in roller 51 into contact with the upper surface of the thermal recording medium 70 and rotates the conveying roller 47 to convey the thermal recording medium 70 into a space between the recording head 52 and the platen roller 53 of the recording unit 50. Also, after the −X end of the thermal recording medium 70 is conveyed into a space between the recording head 52 and the platen roller 53 of the recording unit 50, the main control unit 100 moves the carrying tray 42 to the carry-in position.

In step 303, the main control unit 100 brings the recording head 52 into contact with the upper surface of the thermal recording medium 70 being supported from underneath by the platen roller 53, and causes the recording head 52 to heat the thermal recording medium 70 to a temperature greater than or equal to the temperature T1 while feeding the thermal recording medium 70 in the −X direction by rotating the platen roller 53. As a result, information is recorded on the thermal recording medium 70.

In step 304, the main control unit 100 causes the first ejecting roller 54 and the second ejecting roller 55 to pinch the thermal recording medium 70 and rotates the second ejecting roller 55 to eject the thermal recording medium 70 onto the paper catch tray 60 through the ejecting opening 50*a* formed in the case 10*a*.

In step 305, the main control unit 100 increments the counter m by 1.

In step 306, the main control unit 100 determines whether the value of the counter m equals the number of printing pages N. If the value of the counter m is equal to the number of printing pages N (YES in step 306), the process 1 is terminated. If the value of the counter m is not equal to the number of printing pages N (NO in step 306), the process returns to step 301 and steps 301 through 306 are repeated until the value of the counter m becomes equal to the number of printing pages N.

<Process 2>

In step 401 of the process 2, the main control unit 100 determines whether a thermal recording medium 70 is present in the paper-feed cassette 21. If no thermal recording medium 70 is present in the paper-feed cassette 21 (NO in step 401), the process goes to step 409 and the main control unit 100 sends error information to a higher-order device or an external device and terminates the process 2. If a thermal recording medium 70 is present in the paper-feed cassette 21 (YES in step 401), the process goes to step 402.

In step 402, the main control unit 100 starts supplying power to the erasing head 32 of the erasing unit 30.

In step 403, the main control unit 100 determines whether the temperature of the erasing head 32 has become greater than or equal to the temperature T2. If the temperature is greater than or equal to the temperature T2 (YES in step 403), the process goes to step 404. If the temperature is not greater than or equal to the temperature T2 (NO in step 403), the process returns to step 402 and steps 402 and 403 are repeated until the temperature becomes greater than or equal to the temperature T2.

In step 404, the main control unit 100 rotates the paper-feed roller 23 to feed the thermal recording medium 70 in the paper-feed cassette 21 in the +X direction into a space between the conveying rollers 31 of the erasing unit 30.

In step 405, the main control unit 100 brings the erasing head 32 into contact with the upper surface of the thermal recording medium 70 supported from underneath by the platen roller 33 while moving the thermal recording medium 70 in the +X direction. Then, the main control unit 100 causes the erasing head 32 to heat the upper surface of the thermal recording medium 70 to a temperature greater than or equal to the temperature T2 shown in FIG. 3 and thereby to erase information recorded on the thermal recording medium 70.

After erasing information from the thermal recording medium 70, the main control unit 100 turns the movable part 34*a* to pinch the thermal recording medium 70 between the movable roller 34 and the conveying roller 47. Then, the main control unit 100 rotates the conveying roller 47 to convey the thermal recording medium 70 onto the bed 42*a* of the carrying tray 42. As a result, as indicated by a dotted line in FIG. 4, the thermal recording medium 70 is placed on the carrying tray 42 with its −X end positioned above the conveying roller 47.

In step 406, the main control unit 100 increments the counter n by 1.

In step 407, the main control unit 100 determines whether the value of the counter n is equal to the number of printing pages N. If the value of the counter n is equal to the number of printing pages N (YES in step 407), the process 2 is terminated. If the value of the counter n is not equal to the number of printing pages N (NO in step 407), the process returns to step 402 and steps 402 through 407 are repeated until the value of the counter n becomes equal to the number of printing pages N.

In this embodiment, as described above, when the image forming apparatus 10 is turned on, it is determined whether a thermal recording medium 70 from which information is erased by the erasing unit 30 is present on the carrying tray 42. If no thermal recording medium 70 is present on the carrying tray 42, information on a thermal recording medium 70 is erased (step 205) and the thermal recording medium 70 is placed on the carrying tray 42. With this configuration, information is erased from a thermal recording medium 70 and the thermal recording medium 70 is placed on the carrying tray 42 in advance, i.e., prior to receiving a recording request from a higher-order device. Therefore, when a recording request is received, the image forming apparatus 10 can immediately start recording information on the thermal recording medium 70 without performing preparatory steps such as heating the erasing head 32 and erasing information from the thermal recording medium 70. Thus, the above configuration makes it possible to record information on the thermal recording medium 70 in a short period of time.

Figure 10:
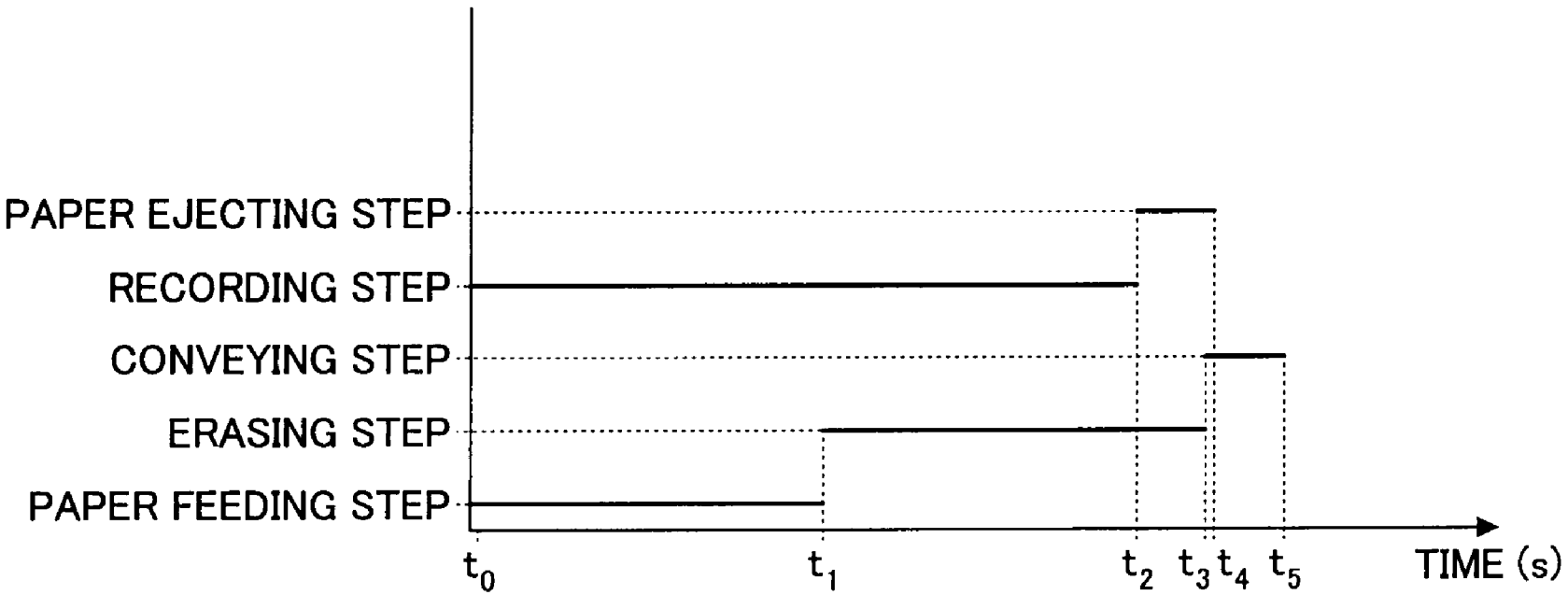
FIG. 10 is a time chart of steps performed in the image forming apparatus 10.

FIG. 10 is a time chart of steps performed in the image forming apparatus 10. In FIG. 10, it is assumed that a recording request is received at time $t_0$. As shown in FIG. 10, the image forming apparatus 10 of this embodiment can concurrently perform a preparatory step including a paper feeding step of conveying the thermal recording medium 70 to the erasing unit 30 and an erasing step of erasing information recorded on the thermal recording medium 70 and a recording step of recording information on the thermal recording medium 70. Thus, the image forming apparatus 10 of this embodiment can complete recording information on the thermal recording medium 70 in a short period of time. In a related-art thermal printer, the recording step can be started only after a period of time from time t0 to time t5 has passed. Meanwhile, according to this embodiment, the time required before starting the recording step can be reduced by the period of time from time t0 to time t5.

According to this embodiment, if no thermal recording medium 70 is present on the carrying tray 42, information on a thermal recording medium 70 is erased prior to the reception of a recording request in the main process; information is recorded on one or more thermal recording media 70 according to the number of printing pages N in the process 1; and information is erased from the same number of thermal recording media 70 in the process 2. With this configuration, while the image forming apparatus 10 is ready to accept a recording request, at least one thermal recording medium 70 is always provided on the carrying tray 42. Therefore, when a recording request is received, the image forming apparatus 10 can immediately start recording information on the thermal recording medium 70 without performing preparatory steps such as heating the erasing head 32 and erasing information from the thermal recording medium 70. Thus, the above configuration makes it possible to record information on the thermal recording medium 70 in a short period of time.

Also in this embodiment, when the image forming apparatus 10 receives a recording request, a process of recording information on a first thermal recording medium 70 (steps 302 through 304) and a process of heating the erasing head 32 (step 402) to erase information on a second thermal recording medium 70 are started at substantially the same time. This configuration makes it possible to reduce the time required before starting information recording on the second thermal recording medium 70 after information recording on the first thermal recording medium 70 is completed.

Further, according to this embodiment, even if power supply to the erasing head 32 is stopped while the image forming apparatus 10 is waiting for a recording request, the erasing head 32 can be heated again while information is being recorded on the thermal recording medium 70. In other words, the main control unit 100 may be configured to start heating the erasing head 32 when a recording request is received. This configuration eliminates the need to keep the temperature of the erasing head 32 at or close to the erasing temperature to be able to start recording information on the thermal recording medium 70 shortly after a recording request is received. This in turn makes it possible to reduce power consumption of the image forming apparatus 10 during standby.

With the image forming apparatus 10 configured as described above, if information is recorded on the thermal recording medium 70 before it is cooled to a certain temperature after prerecorded information is erased, the parts of the thermal recording medium 70 where information is recorded are, in effect, cooled slowly and as a result, the color optical density may become insufficient. To solve or reduce this problem, the image forming apparatus 10 of this embodiment is preferably configured to quickly cool (forced cooling) the thermal recording medium 70 immediately after the prerecorded information is erased. This can be achieved, for example, by providing a cooling mechanism in the image forming apparatus 10. A cooling mechanism may be implemented by making the carrying tray 42 using a material with a high thermal conductivity or by providing a separate radiating part with a high thermal conductivity on the bed 42*a* of the carrying tray 42.

In this embodiment, in steps 201 through 205, information is erased from one thermal recording medium 70 and the thermal recording medium 70 is temporarily stored in the carrying tray 42 before a recording request is received or before information is recorded on the thermal recording medium 70. However, the present invention is not limited to the above disclosed embodiment. For example, the image forming apparatus 10 may be configured to erase information from multiple thermal recording media 70 in advance and to temporarily store the multiple thermal recording media 70 in a container of the carrying tray 42 capable of holding multiple thermal recording media 70.

The temperature characteristics of the thermal recording medium 70 shown in FIG. 3 are given as an example, and the thermal recording medium 70 may have different temperature characteristics. The thermal recording medium 70 having different temperature characteristics can be handled by the image forming apparatus 10 by properly setting the heating temperatures of the erasing unit 30 and the recording unit 50.

Embodiments of the present invention provide an information recording apparatus and an information recording method that make it possible to reduce the time required before starting information recording on a recording medium after receiving a recording request and thereby make it possible to quickly record information on a recording medium.

According to an embodiment of the present invention, when a recording request to start information recording is received, a step of recording information on a first recording medium, from which prerecorded information is erased, is started and also a step of erasing prerecorded information on a second recording medium is started at substantially the same time. This configuration makes it possible to start recording information on the first recording medium shortly after the recording request is received and thereby makes it possible to complete information recording in a short period of time. Also, because information on the second recording medium is erased while information is being recorded on the first recording medium, it is possible to reduce the time required before starting information recording on the second recording medium after information recording on the first recording medium is completed.

The present invention is not limited to the specifically disclosed embodiments, and variations and modifications may be made without departing from the scope of the present invention.

The present application is based on Japanese Priority Application No. 2008-214479, filed on Aug. 22, 2008, the entire contents of which are hereby incorporated herein by reference.

What is claimed is:

1. An information recording apparatus, comprising:

an erasing unit configured to erase prerecorded information on recording media capable of being colored and decolored by heat;

a recording unit configured to record information on the recording media from which the prerecorded information is erased; and a control unit configured, when a recording request is received, to cause the recording unit to start recording information on a first one of the recording media and to cause the erasing unit to start erasing prerecorded information on a second one of the recording media.

2. The information recording apparatus as claimed in claim 1, wherein the control unit is configured to cause the erasing unit to erase prerecorded information on the first one of the recording media before the recording request is received.

3. The information recording apparatus as claimed in claim 1, wherein the erasing unit includes a heating device configured to heat the recording media; and the control unit is configured to start heating the heating device when the recording request is received.

4. The information recording apparatus as claimed in claim 1, further comprising:

a cooling mechanism configured to cool the recording media from which the prerecorded information is erased.

5. The information recording apparatus as claimed in claim 1, further comprising:

a conveying mechanism configured to convey the recording media from the erasing unit to the recording unit.

6. The information recording apparatus as claimed in claim 1, further comprising:

a temporary storing mechanism configured to temporarily store the recording media, from which the prerecorded information is erased, before the recording request is received.

7. The information processing apparatus as claimed in claim 6, wherein the temporary storing mechanism is configured to temporarily store at once a plurality of the recording media from which the prerecorded information is erased.

8. An information recording method, comprising:

a first step of starting to record information on a first recording medium when a recording request is received; and a second step of starting to erase prerecorded information on a second recording medium when the recording request is received.

9. The information recording method as claimed in claim 8, wherein the second step includes a step of starting to heat a heating device for erasing the prerecorded information on the second recording medium when the recording request is received.

10. The information recording method as claimed in claim 8, wherein the first step and the second step are started at substantially the same time.

11. The information recording method as claimed in claim 8, further comprising:

an erasing step of erasing prerecorded information on the first recording medium before the recording request is received.

12. The information recording method as claimed in claim 8, further comprising:

a cooling step of cooling the second recording medium from which the prerecorded information is erased.

13. The information recording method as claimed in claim 11, wherein in the erasing step, prerecorded information is erased from a plurality of recording media before the recording request is received.

* * * * *